United States Patent [19]

Boyes et al.

[11] 3,955,714

[45] May 11, 1976

[54] VACUUM OPERATED MATERIAL TRANSFER SYSTEM

[75] Inventors: Jerry Walter Boyes; Raymon Kelsick Elkins, both of Arlington; Richard Neil Hutson, Dallas; William Carroll Reed, Arlington, all of Tex.

[73] Assignee: The Hutson Corporation, Arlington, Tex.

[22] Filed: June 12, 1975

[21] Appl. No.: 586,247

[52] U.S. Cl. ..... 222/132; 137/205

[51] Int. Cl.[2] ..... B67D 5/60

[58] Field of Search ..... 141/115, 119, 59; 15/95; 137/205; 222/132, 373

[56] References Cited

UNITED STATES PATENTS 3,114,479 12/1963 Keeney ..... 222/132 X

*Primary Examiner*—Stanley H. Tollberg

*Attorney, Agent, or Firm*—Richards, Harris & Medlock

[57] ABSTRACT

In a material transfer system, a substantially airtight hopper is rotatably supported at the top of an upright column which is in turn supported by a base. The hopper may be divided into a plurality of compartment sections, and inlet and outlet ports are provided for each hopper compartment. A vacuum pump is connected to the interior of the hopper through the column. A hose is adapted for connection to one of the inlet ports to direct material into the hopper, and sealing apparatus is provided for closing the remainder of the inlet ports. Each discharge port is provided with a chute for receiving and transferring material under the action of gravity. Drain apparatus is provided for receiving liquid from each discharge port. Each discharge port is further provided with structure for sealing the discharge port in response to the presence of vacuum within the hopper.

10 Claims, 5 Drawing Figures

VACUUM OPERATED MATERIAL TRANSFER SYSTEM

BACKGROUND AND SUMMARY OF THE INVENTION

This invention relates to material transfer systems, and more particularly to a vacuum operated material transfer system which is particularly useful in conjunction with vibratory finishing machines.

At the present time vibratory finishing machines are utilized in industry to fabricate and finish a substantially limitless number of parts and products. In the use of such a machine, the parts or products to be treated are introduced into the hopper of the finishing machine together with a suitable media. A liquid such as water and/or a finishing agent may also be used. The machine is then actuated to vibrate the hopper and the contents thereof, whereby the media and the parts or products in the hopper are brought into repeated engagement with each other. In this manner the parts or products are fabricated or finished.

Tumbling barrels have also gained wide-spread acceptance in industry. This type of machine also employs a hopper which receives parts or products to be treated and a suitable media. The hopper is then rotated about a horizontal axis to repeatedly engage the media with the parts or products.

The types of media which are utilized in vibratory finishing machines and tumbling barrels vary almost as much as the products and parts which are operated upon. For example, the media may comprise such diverse materials as ceramic, plastic, metal, glass, wooden and various composite materials. Likewise, the media may comprise various diverse shapes such as balls, cones, disks, cylinders, triangles, stars, pyramids, polyforms, and other geometric shapes, as well as random shapes. It will be understood that at the completion of a particular operation in a vibratory finishing machine, it is often necessary to remove the media from the hopper of the machine and to replace the media with a different media formed from a different material and/or having a different shape.

The present invention comprises a material transfer system which is particularly adapted to transfer media to and from the hoppers of vibratory finishing machines, tumbling barrels and similar devices. In accordance with the broader aspects of the invention, a column is supported in a vertical orientation by a base and supports a hopper. The hopper is of airtight construction, and a vacuum pump is connected to the interior of the hopper through the column.

The hopper may be divided into one or more compartments. If plural hopper compartments are used, the hopper is preferably rotatably supported on the column. Each hopper compartment is provided with an inlet port and an outlet port. A hose is provided for connection to the inlet port whereby media is drawn into the hopper compartment under the action of the vacuum pump. If the hopper is provided with more than one compartment, sealing apparatus is provided for the inlet ports not in use.

The discharge port is mounted in the bottom of the hopper to discharge media therefrom under the action of gravity. The discharge port is normally closed by a pivotally supported gate which also functions to seal the discharge port whenever vacuum is established within the hopper. The discharge port may also be provided with structure for directing liquid flowing therefrom to a drain.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
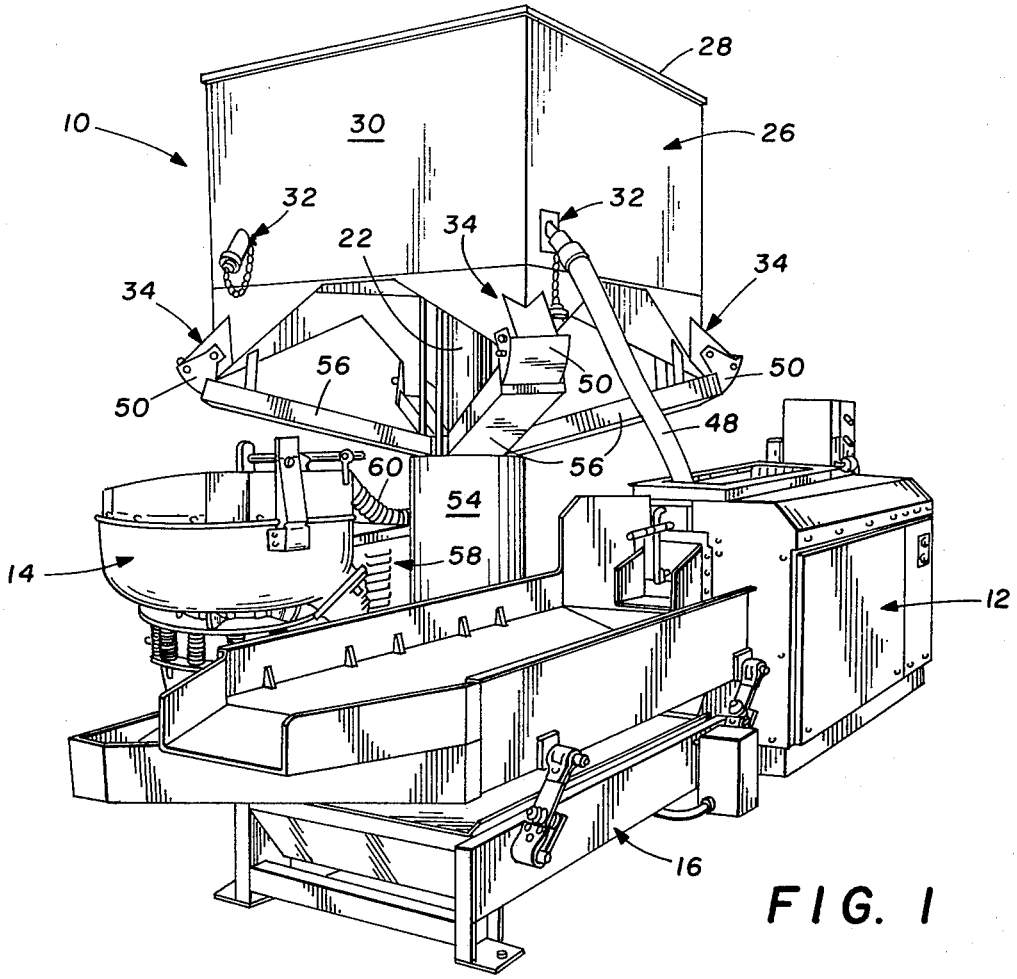
FIG. 1 is a perspective view illustrating a material transfer system incorporating the invention and showing the use thereof.

Referring now to the Drawings, and particularly to FIG. 1 thereof, there is shown a material transfer system 10 incorporating the present invention. The material transfer system 10 is particularly adapted for use in conjunction with vibratory finishing machines. For example, in FIG. 1 there is shown a vibratory finishing machine 12 of the type having a rectangular hopper and a vibratory finishing machine 14 of the type having a toroidal bowl hopper. FIG. 1 further illustrates a separator 16. By means of such a device the material transfer system of the present invention may be utilized in conjunction with virtually any type of vibratory finishing machine, and can also be utilized in conjunction with tumbling barrels, and the like.

Figure 2:
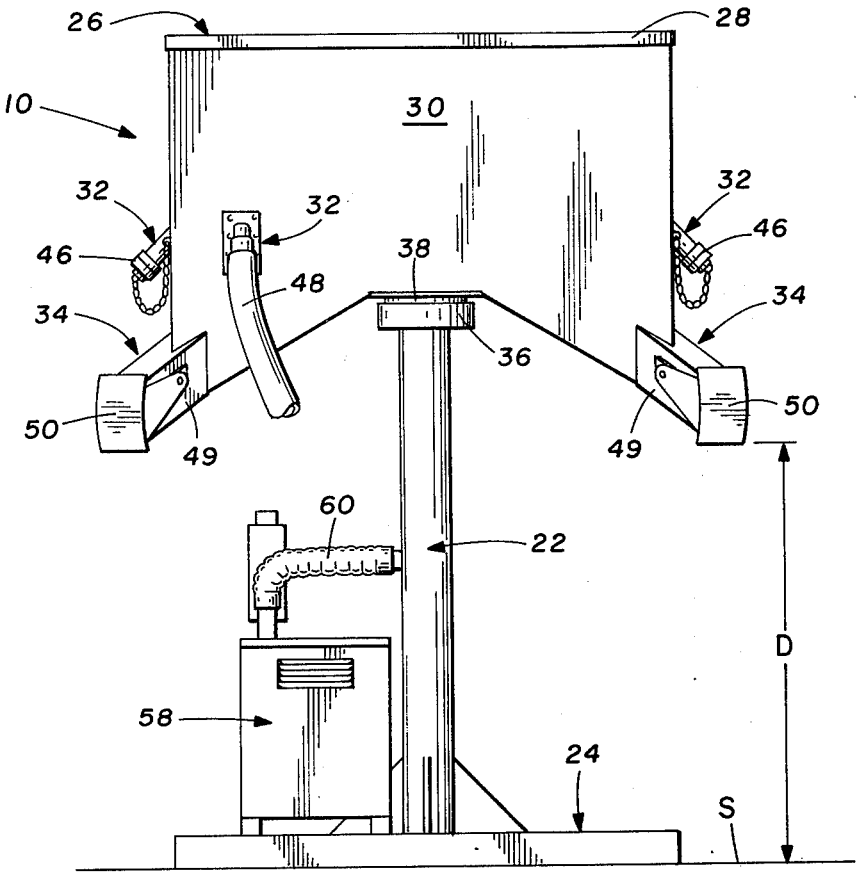
FIG. 2 is a side view further illustrating the material transfer system of FIG. 1.

Referring to FIG. 2, the material transfer system 10 incorporates a column 22. The column 22 is supported in an upright or vertical orientation on a surface S by means of a base 24. The base also permits the material transfer system 10 to be moved from place to place on the surface S.

A substantially airtight hopper 26 is supported on the column 22. The hopper 26 includes a cover 28 and a plurality of side walls 30. The hopper 26 further includes one or more inlet ports 32 and one or more discharge ports 34.

Figure 3:
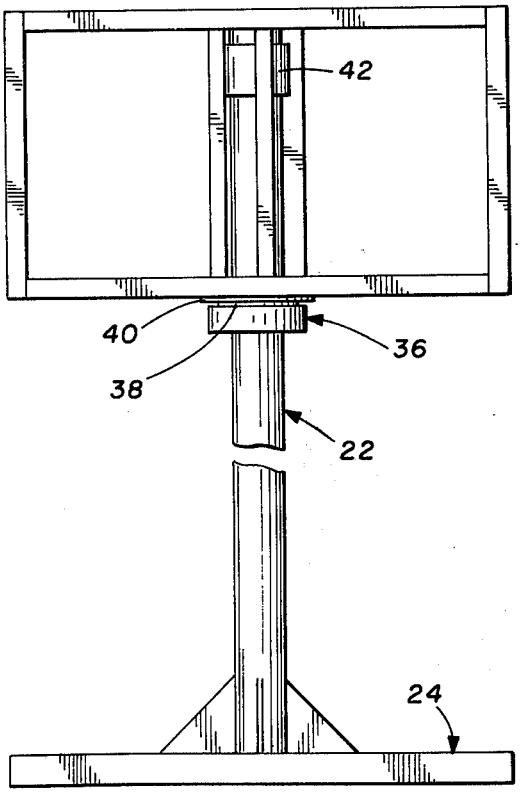
FIG. 3 is a view similar to FIG. 2 in which certain parts have been broken away more clearly to illustrate certain features of the invention.

As is best shown in FIG. 3, a collar 36 is provided on the column 22. A bearing plate 38 is supported on the collar 36. A mating bearing plate 40 is mounted on the hopper 26. The column 22 extends into the hopper and a bearing collar 42 is provided between the column and the hopper. By means of the plates 38 and 40 and the collar 42, the hopper 26 is fully rotatable relative to the column 22 and the base 24.

Figure 4:
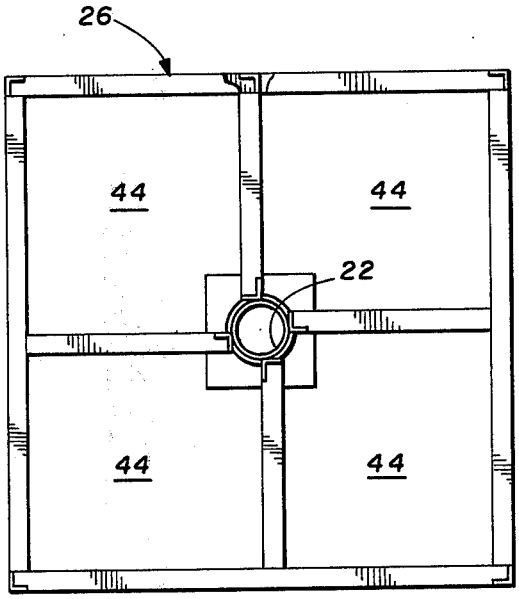
FIG. 4 is a top view of the hopper of FIG. 3.

Referring to FIG. 4, the interior of the hopper 26 may be provided into a plurality of compartments 44. Thus, the hopper 26 illustrated in FIG. 4 is divided into a total of four compartments 44. The hopper 26 is provided with at least one inlet port 32 and at least one discharge port 34 corresponding to and extending to each of the compartments 44.

The purpose of rotatably supporting the hopper 26 on the column 22 is to permit the discharge port 34 of a particular hopper compartment 44 to be aligned with the hopper of a vibratory finishing machine, a tumbling barrel or similar device. This in turn permits the contents of the hopper compartment 44 to be discharged into the hopper of the vibratory finishing machine, etc. under the action of gravity. It will be understood, however, that a hopper 26 having a single compartment 44 may fulfill the needs of certain applications, and that in such cases the ability to rotate the hopper on the column may not be necessary or desirable. In such instances the use of the bearing plates 38 and 40 and the bearing collar 42 to rotatably support the hopper on the column is dispensed with, and the hopper is fixedly mounted on the column.

As is best shown in FIG. 2, each inlet port 32 of the hopper 26 is provided with a plug 46 which is utilized to seal the inlet port whenever it is not in use. A vacuum hose 48 is provided for connection to the particular inlet port 32 that is in use at any given time. By this means material such as the media that is is utilized in vibratory and tumbling type finishing operations may be selectively directed into any one of the compartments 44 comprising the hopper 26 of the material transfer system 10.

The discharge ports 34 are positioned at the corners of the hopper 26. Each discharge port 34 includes a chute 49 comprising a hollow rectangular tubing section extending downwardly from the corner of the hopper. A gate 50 is pivotally supported on the chute 49 and is utilized to normally close the discharge port, thereby permitting material contained within the section of the hopper individual to the discharge port from flowing outwardly through the discharge port.

Figure 5:
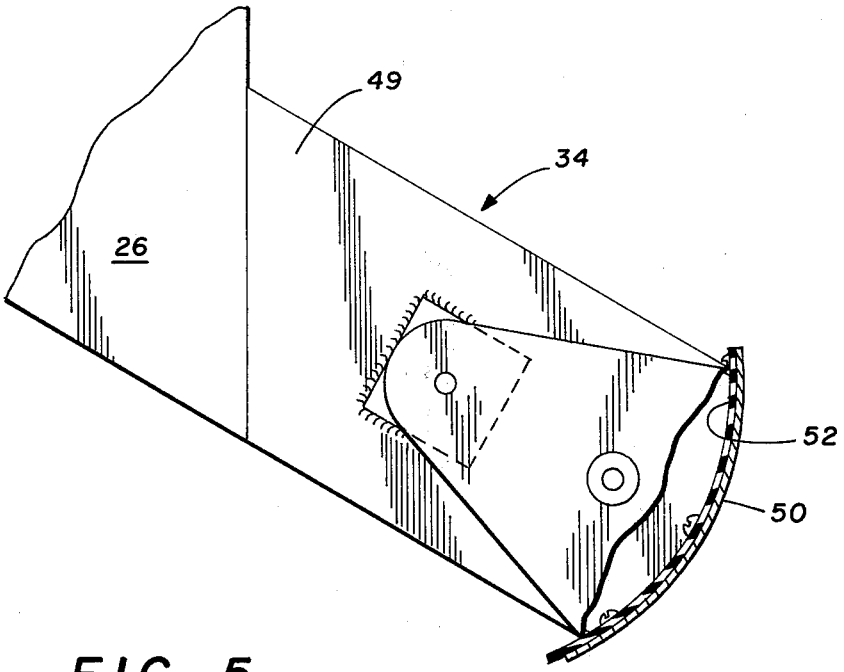
FIG. 5 is a partial sectional view illustrating the construction of the discharge ports of the material transfer system.

Referring to FIG. 5, the interior of each gate 50 comprises a layer of elastomeric material 52. Whenever the gate 50 is closed and vacuum is established within the hopper 26, the layer of elastomeric material 52 is drawn into engagement with the edges of the chute 49. By this means the discharge port 34 is effectively sealed.

As is best shown in FIG. 1, a drain 54 encircles the column 22 of the material transfer system 10. A plurality of spillways 56 each extend from one of the discharge ports 34 to the drain 54. The spillways 56 and the drain 54 function to carry away liquid which may be drawn into the hopper 26 and which are discharged through the discharge port 34 thereof.

Referring again to FIG. 2, the material transfer system 10 further includes a vacuum pump 58. Any conventional type of vacuum pump may be utilized in the practice of the invention. A flexible hose 60 connects the vacuum pump 58 to the interior of the column 22. The column 22 in turn connects the vacuum pump to the interior of the hopper 26. By this means, vacuum is established within the hose 48 connected to the selected inlet port 32.

OPERATION

In the use of the invention, the hose 48 is connected to the inlet port 32 extending to a selected compartment 44 within the hopper 26. Thereafter the vacuum pump 58 is actuated to establish vacuum within the hopper 26. The hose 48 is then utilized to draw media into the selected compartment 44 from the tub or hopper of a vibratory finishing machine. In the case of a tumbling barrel, the media is first discharged onto a separator and is then drawn into the hopper 26 utilizing the hose 48.

After all of the media from a first finishing operation has been removed and drawn into the hopper 26, different media may be placed in the hopper of the vibratory finishing machine or in the tumbling barrel. This is accomplished by rotating the hopper 26 relative to the column 22 to properly align the discharge port extending to the compartment 44 of the hopper 26 having the desired media therein. Then, the gate 50 of the discharge port is rotated to open the discharge port, whereupon the media flows through the chute 49 under the action of gravity.

From the foregoing, it will be understood that in order to function properly in conjunction with vibratory finishing machines and similar apparatus, the hopper 26 of the material transfer system of the present invention must be positioned a predetermined distance above the surface S. Referring again to FIG. 2, it has been found that if the dimension D is approximately 44 in., the hopper 26 of the material transfer system 10 is properly positioned for use in conjunction with virtually all commercially available vibratory finishing machines. If this dimension is substantially reduced, the discharge ports 34 of the material transfer system 10 are not positioned high enough to discharge media into the hopper of a vibratory finishing machine under the action of gravity. Conversely, if this dimension is substantially increased, too much vacuum force is required in order to draw the media into the hopper, and the discharge from the discharge ports 34 under the action of gravity cannot be easily controlled.

Although preferred embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

What is claimed is:

1. A material transfer system comprising:
a vertically disposed column;
base means for supporting the column on a surface;
substantially airtight hopper means;
means supporting the hopper means on the column;
means forming a source of vacuum;
means extending through the column for connecting the interior of the hopper means to the source of vacuum;
said hopper means having at least one inlet port formed therein;
hose means connected to the inlet port of the hopper means for directing material into the hopper means through the inlet ports thereof;
said hopper means having at least one discharge port formed in the bottom thereof; and
means responsive to the presence of vacuum in the hopper means for sealing the discharge port of the hopper means.

2. The material transfer system according to claim 1 further characterized by means separating the interior of the hopper means into a plurality of compartments, and wherein the hopper means is further characterized by inlet and discharge ports individual to each of the compartments, and further including means rotatably supporting the hopper means on the column.

3. The material transfer system according to claim 1 wherein the column supports the hopper means with the bottom of the discharge port positioned about 44 inches above the surface, thereby facilitating the transfer of materials from the hopper means under the action of gravity.

4. The material transfer system according to claim 1 further characterized by drain means surrounding the column, and means for directing liquids flowing from the discharge port of the hopper means to the drain means.

5. The material transfer system according to claim 1 wherein:

the hopper means is divided into a plurality of compartments and is further characterized by inlet and discharge ports individual to each compartment;

the hopper means is rotatably supported at a predetermined height above the surface, thereby facilitating the use of the discharge ports to transfer materials under the action of gravity;

and further including drain means; and means for directing liquids from the discharge ports to the drain means.

6. A material transfer system comprising:

substantially airtight hopper means;

said hopper means having at least one inlet port formed therein;

hose means for directing material into the hopper means through the inlet port thereof;

said hopper means having at least one discharge port formed at the bottom thereof;

said discharge port including chute means for directing material away from the hopper means under the action of gravity;

a vertically disposed column extending into the hopper means;

means supporting the hopper means on the column;

base means supporting the column and the hopper means mounted thereon on a surface, and facilitating repositioning of the column and the hopper means mounted thereon relative to the surface;

means forming a source of vacuum; and means connecting the vacuum source of the interior of the hopper means through the column.

7. The material transfer system according to claim 6 wherein the interior of the hopper means comprises a plurality of compartments for receiving different types of materials, and further characterized by an inlet port and a discharge port individual to each of the compartments of the hopper means, and further including means rotatably supporting the hopper means on the column.

8. The material transfer system according to claim 7 wherein the hose means is selectively connectable to any of the inlet ports of the hopper means, and further including means for selectively sealing the remaining inlet ports thereof.

9. The material transfer system according to claim 6 wherein the hopper means is supported on the column with the discharge port thereof positioned a predetermined distance above the surface to facilitate transfer of material from the hopper means through the chute means under the action of gravity.

10. The material transfer system according to claim 6 further including drain means and means for directing liquids from the discharge port of the hopper means to the drain means.

* * * * *